US005373960A

United States Patent [19]

Gunn et al.

[11] Patent Number: 5,373,960

[45] Date of Patent: Dec. 20, 1994

[54] SNAP LOCK PACKAGE FOR GRANULAR DETERGENTS HAVING A REDUCED LINER TO PREVENT BULGING

[75] Inventors: Charles L. Gunn, Lawrenceburg, Ind.; Dennis J. Ruehl, Cincinnati, Ohio

[73] Assignee: The Procter & Gamble Company, Cincinnati, Ohio

[21] Appl. No.: 109,133

[22] Filed: Aug. 19, 1993

[51] Int. Cl.[5] ..... B65D 5/54; B65D 5/56; B65D 5/68

[52] U.S. Cl. ..... 220/416; 220/418; 229/225

[58] Field of Search ..... 220/408, 410, 416, 418; 229/225, 237, 917

[56] References Cited

U.S. PATENT DOCUMENTS

| | | | |
|---|---|---|---|
| 2,348,377 | 5/1944 | Goodyear | 229/225 |
| 2,369,387 | 2/1945 | Williamson et al. | 229/44 |
| 2,403,698 | 7/1946 | Williamson et al. | 229/44 |
| 3,140,809 | 7/1964 | Hickin et al. | 229/37 |
| 3,207,416 | 9/1965 | Koltz et al. | 229/225 |
| 4,102,457 | 7/1978 | Meyers | 206/611 |
| 4,141,449 | 2/1979 | Stone | 206/621 |
| 4,284,193 | 8/1981 | Roccaforte | 206/45.31 |
| 4,314,643 | 2/1982 | Forbes, Jr. | 206/626 |
| 4,542,847 | 9/1985 | Lindstrom | 229/16 D |
| 4,679,694 | 7/1987 | Donohie et al. | 206/611 |
| 4,688,677 | 8/1987 | Roccaforte | 206/624 |
| 4,726,471 | 2/1988 | Whately et al. | 220/416 |
| 4,732,315 | 3/1988 | Gunn | 229/917 |
| 4,768,703 | 9/1988 | Sosler et al. | 229/123.1 |
| 4,986,420 | 1/1991 | Gunn et al. | 206/607 |
| 5,161,734 | 11/1992 | Ruehl et al. | 229/227 |
| 5,209,394 | 5/1993 | Griffiths et al. | 229/225 |
| 5,219,089 | 6/1993 | Kiolbasa et al. | 220/416 |
| 5,236,123 | 8/1993 | Stone et al. | 220/418 |
| 5,238,179 | 8/1993 | Hart | 220/418 |
| 5,265,799 | 11/1993 | Stone | 220/418 |
| 5,299,732 | 4/1944 | Armor et al. | 220/416 |
| 5,314,114 | 5/1994 | Stone | 220/416 |
| 5,320,279 | 6/1994 | Giblin et al. | 220/496 |

*Primary Examiner*—Gary E. Elkins
*Attorney, Agent, or Firm*—Dean L. Garner

[57] ABSTRACT

A snap lock, top opening package for powdered or granular products. The package includes a liner disposed within the interior compartment of the container. The liner has a front panel and two opposing side panels connected to the front panel, wherein the front and side panels are contiguous with the front and side walls of the container. The liner has a top edge which extends above the portions of the front and side walls below the tear-strip. The front panel has a locking flap extending across its top edge along a fold line. The locking flap extends outwardly from the package when the lid is opened and cooperates with a securing tab on the lid when the lid is closed. The securing tab extends along the interior of the front portion of the lid, wherein the locking flap and securing tab form a snap lock for the lid of the package. The liner further includes two back panel flaps extending partially, but fully, across the back wall of the container, so that when the container is filled with product, bulging of the front panel is substantially reduced due to the reduced liner along the back wall.

17 Claims, 5 Drawing Sheets

16
48
70
33
18
32
20

SNAP LOCK PACKAGE FOR GRANULAR DETERGENTS HAVING A REDUCED LINER TO PREVENT BULGING

FIELD OF THE INVENTION

The present invention relates to snap-lock packages, and more particularly, to such packages for storing granular products.

BACKGROUND OF THE INVENTION

Many products are provided to consumers in granular form which includes any form which has physical characteristics similar to granular materials, such as powders. Among the list of granular consumer products are many laundry detergents and dish washing detergents. Granular detergents are generally used in relatively large volumes. Consequently, large volumes of these products are consumed each year. Due to the vast quantity of consumer products sold in granular form, there is a great demand for packages to house these products.

Packages for granular consumer products should have several key characteristics. The package must be able to withstand the rigors of transportation from the manufacturer to the retailer and to the ultimate place of use by the consumer. It is also desirable that the package enable the consumer to remove product therefrom as simply as possible. An example of a preferred package for housing granular products is given in U.S. Pat. No. 4,986,420 PACKAGE WITH MULTIPLY SIDE PANELS AND STRAP HANDLE, issued to Gunn et al. on Jan. 22, 1991, which is hereby incorporated herein by reference. The Gunn reference discloses a substantially rectangular package having a hinged lid and a bayonet handle. The package includes a full length liner along the front, back and side walls (all of said walls being referred to as a single "side wall" in the Gunn at al. reference but will be referred to herein as separate front back and side walls) to help prevent sifting of the product out of the package.

Recently, however, there has been a desire to provide locking flaps to the above package so as to form a snap-lock package. Snap-lock packages reduce the amount of product that is lost when the lid of the package is opened, holds the lid in place if the package is turned over in storage or transit and also helps prevent against inadvertent opening of the package. An example of a snap-lock carton for granular materials is given in U.S. Pat. No. 5,161,734 RECLOSABLE CARTON FOR GRANULAR MATERIALS, issued to Ruehl et al. on Nov. 10, 1992, which is hereby incorporated herein by reference. However, when a snap-lock arrangement of the type disclosed in Ruehl is applied to a package of the type disclosed in Gunn, that is a package having a full length liner and generally shown in FIG. 16 of the Ruehl reference, many problems arise. The weight of the granular material housed within the package causes the package to bulge, particularly when the package is large and houses large amounts of granular product. When the package bulges along the front wall, the locking flap (referred to as the "proximal locking portion" in Ruehl et al. but referred to herein as the locking flap) will begin to curl and the snap-lock feature of the package will not function. There has, therefore, been a desire to provide a snap-lock package for housing granular materials having a liner to prevent sifting and wherein bulging of the front wall is substantially prevented so that the locking-flap will not curl and the snap-lock feature will operate.

It is, therefore, an object of the present invention to provide a snap lock package for housing granular detergents having good anti-sift properties and wherein the front wall of the package is substantially prevented from bulging so that the snap-lock continues to operate throughout the use of the package.

It is another object of the present invention to provide such a package that is inexpensive to manufacture.

It is another object of the present invention to provide such a package that can be easily stacked, before being erected, in a warehouse or the like.

It is another object of the present invention to provide such a package that is easy for the consumer to open.

The aforementioned and other objects of the present invention will become more apparent hereinafter.

SUMMARY OF THE INVENTION

In accordance with the present invention there is provided a snap lock, top opening package for powdered or granular products. The package includes a container having opposing top and bottom walls, opposing front and back walls, and opposing side walls, all of which are connected together to form an interior chamber for containing the product. The container has a tear-strip extending across the front wall and at least partially across each side wall so that when the tear-strip is removed a lid is defined having front and side portions and being hinged along at least one of said back wall and said top wall.

The package further includes a liner disposed within the interior compartment of the container. The liner has a front panel and two opposing side panels connected to the front panel, wherein the front and side panels are contiguous with the front and side walls of the container. The liner has a top edge which extends above the lower portions of the front and side walls of the container, below the tear-strip. The front panel has a locking flap extending longitudinally across its top edge along a fold line. The locking flap extends outwardly from the package when the lid is opened. The locking flap cooperates with a securing tab, extending longitudinally along the interior of the front portion of the lid, so as to form a snap lock for the lid. The liner further includes two back panel flaps extending along the back wall of the container. Each of the back panel flaps extend longitudinally along the back wall of the container a distance less than half the length of the back wall, between the side walls.

BRIEF DESCRIPTION OF THE DRAWINGS

While the specification concludes with claims which particularly point out and distinctly claim the subject matter forming the present invention, it is believed that the invention will be better understood from the following description of the preferred embodiment taken in conjunction with the accompanying drawings in which like reference numerals identify identical elements and wherein:

DESCRIPTION OF THE PREFERRED EMBODIMENTS

Figure 1:
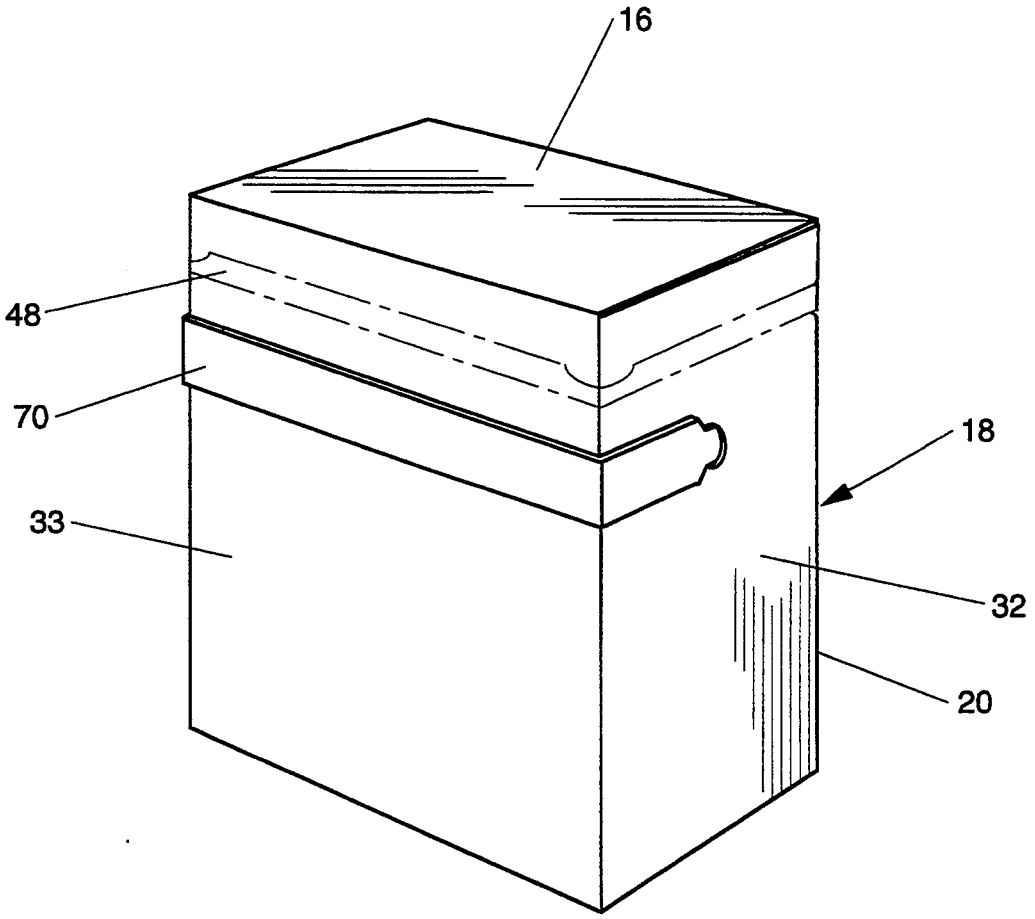
FIG. 1 is a perspective view of a preferred embodiment of the package of the present invention.
Figure 2:
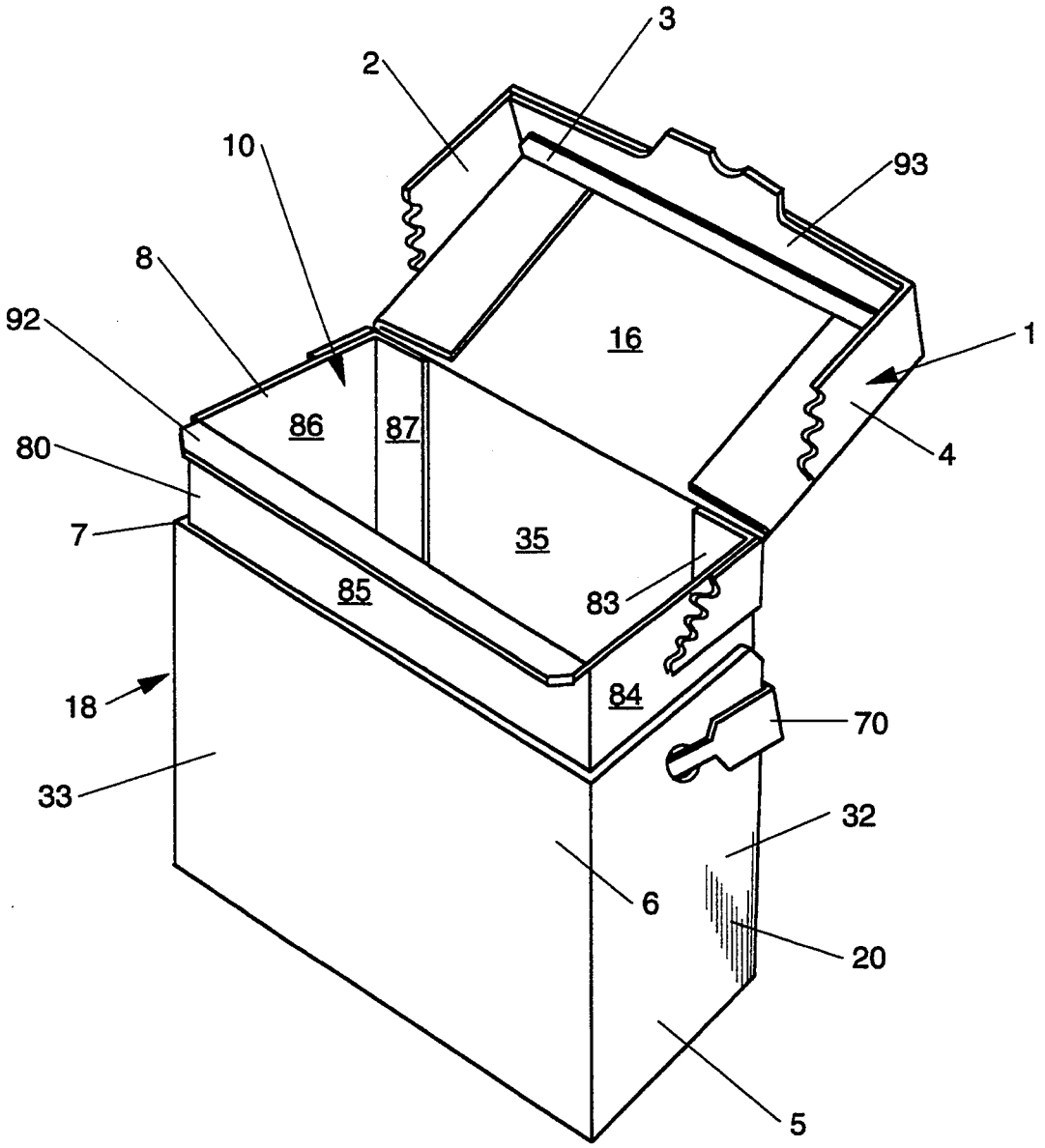
FIG. 2 is a perspective view of the embodiment of FIG. 1 with the tear-strip removed and the package lid open.

Referring now to the drawings, wherein like numerals indicate the same element throughout the views, there is shown, in FIGS. 1 and 2, a perspective view of a particularly preferred embodiment of a package 18 in accordance with the present invention. Package 18 includes a container 20 having opposing front and back walls 33 and 35, opposing side walls 32 and 34 (shown in FIG. 4), and opposing top and bottom walls 16 and 17 (not shown) all of which are connected together to form interior compartment 10 for housing a granular or powdered product. The container 20 further includes a tear-strip 48 extending across the front wall 33 and at least partially across each side wall 32 and 34. When the tear-strip is removed, as shown in FIG. 2, a lid 1, having front and side portions 3, 2 and 4, is defined which is hinged along at least one of the back wall 35 or top wall 33. FIG. 2 shows the lid as being hinged along the top of the back wall near or at the juncture of the front and back walls. Removal of the tear-strip and opening of the lid defines the lower remaining portions 5, 6 and 7 of front, back and side walls 32, 33 and 34 below the tear-strip.

Package 1 further includes a liner 80 disposed within the interior compartment 10 which helps prevent sifting of granular product out of package 18 and also provides extra-top load strength for the package. Liner 80 has a front panel 85 and two opposing side panels 84 and 86 connected to the front panel. Front and side panels 85, 84 and 86 are contiguous with the front and side walls 33, 32 and 34 of container 20. Liner 80 has a top edge 8 which extends above lower remaining portions 5, 6 and 7 when the lid is opened, and preferably abuts against top wall 16 when the lid the closed to give added top load strength. Front panel 85 has a locking flap 92 extending longitudinally along its top edge along a fold line. As seen from the figures it is preferred that the locking flap extend along the full length of panel 85. The locking flap extends outwardly from the package when the lid is opened. The locking flap 92 cooperates with a securing tab 93 when the lid is closed. Securing tab 93 extends longitudinally along the interior of front portion 3 of lid 10. Locking flap 92 and securing tab 93 cooperate together to form a snap lock for lid 10, the types of which are well known in the art.

Figure 5:
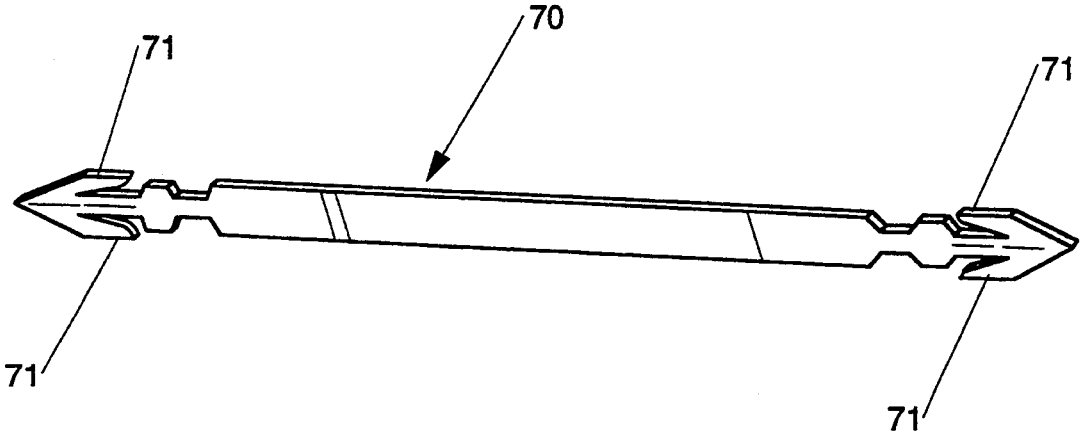
FIG. 5 is a simplified perspective view of a handle 70 which can be added to the package of the present invention.

FIGS. 1 and 2 also show package 18 as having a handle 70, which is better shown in FIG. 5. Any type of handle known in the art which is suitable for the package of the present invention. Handle 70, shown in the figures, is known in the art as a bayonet handle as is generally described in U.S. Pat. No. 5,137,209 BAYONET HANDLE PACKAGE issued to Roberts et al. on Aug. 11, 1992, which is hereby incorporated herein by reference. The barbs 71 of the handle are inserted into apertures on the packages side walls so as to be disposed between the side wall and the liner, thereby securing handle 70 to package 18. A handle 70 is not necessary to carry out the present invention but can be added to the package for easy carrying.

In order to prevent bulging of the front wall 33, when the package is full of product, the liner 80 is not extended fully across the back wall 35. In prior art packages, such as that shown in FIG. 16 of incorporated reference U.S. Pat. No. 5,161,734, the liner extends fully across the back wall. Here a portion of the liner extending along the back wall has been, in effect, removed. Partially removing the back panel of the liner will cause most of the bulging to occur on the back wall 35 and not on the front wall 33. Instead of having a full length back panel for the liner, the present invention has two back panel flaps 83 and 87 extending from side panels 84 and 86. The back panel flaps together extend partially but fully across the length of back wall 35. That is the length of back wall 35 as measured from side wall to side wall is greater than the combined lengths of back panel flaps 83 and 87 when measured in the same direction. Because the weight of the granular product will cause the package to bulge in the direction of least resistance, the back of the package will bulge more than the front because it is comprised of less layers than the front of the package. Preferably the width of each back panel flap, or the distance that it extends across the back wall is greater than about ½ in. (1.27 cm.) and most preferably greater than about ⅞ in. (2.22 cm.) so that effective gluing between the back panel flaps and the back wall can be obtained. The reduced back liner of the present invention is so effective that the container 20 can be made out of thinner materials without jeopardizing the functionality of the snap-lock feature.

Figure 3:
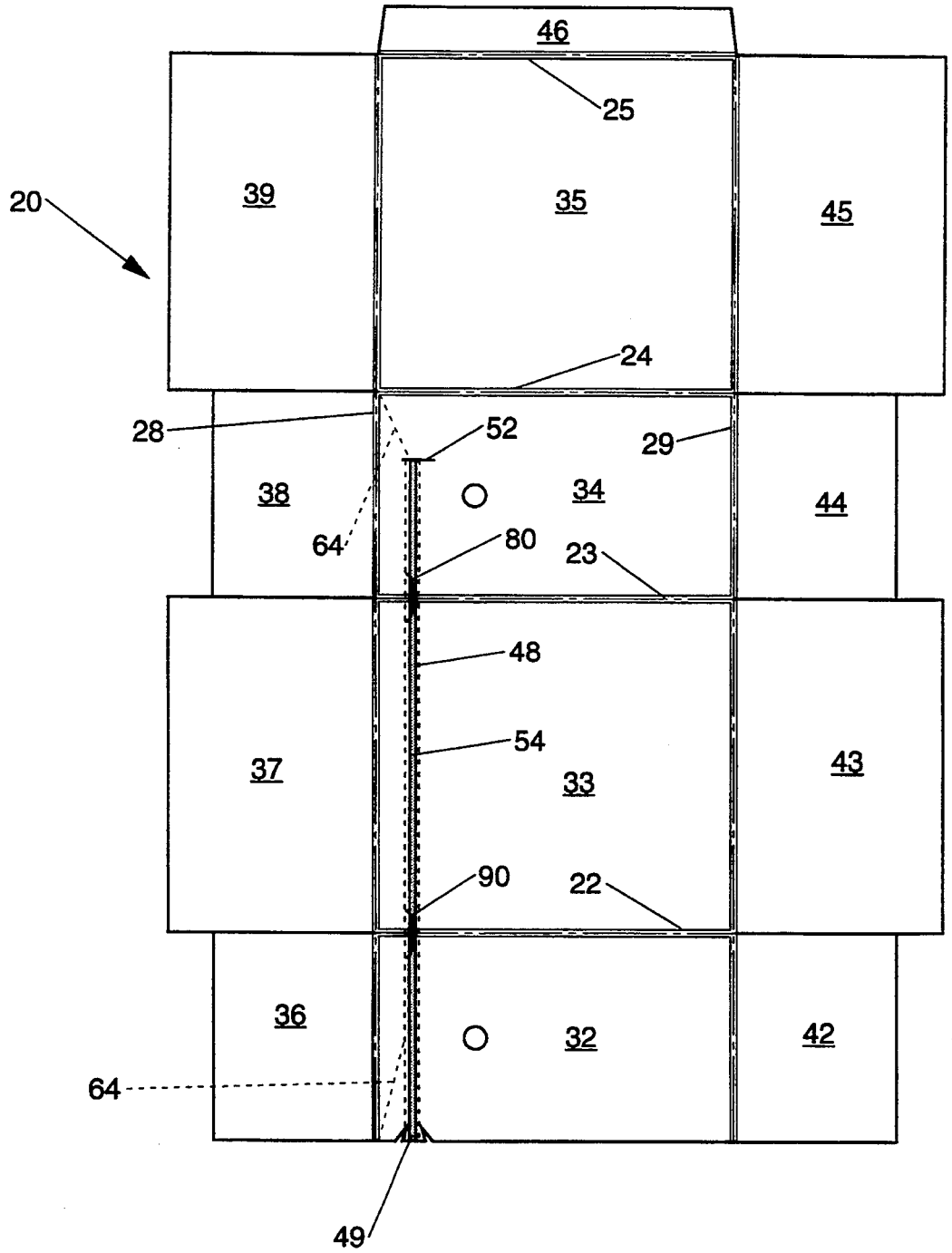
FIG. 3 is a plan view of the blank of the container used to make the package of FIG. 1.

Referring to FIG. 3, the container 20 is preferably made from carton board, although other suitable materials known in the art can be used. The blank used to form container 20 has four axial score lines 22, 23, 24 and 25 and two transverse score lines 28 and 29. The front, back and side walls 33, 35, 32 and 33 are located between transverse score lines 28 and 29. Four flaps 36, 37, 38 and 39 are hingedly attached to score line 28 and combine to make top wall 16 of container 20 when assembled. Similarly, four flaps 42, 43, 44 and 45 are hingedly attached at score line 29 and combine to make bottom wall 17 when assembled. A glue seam flap 46 is hingedly attached along axial score line 25.

Tear-strip 48 extends along the front wall 33 and at least partially across side walls 32 and 34 adjacent transverse score line 28. The tear-strip 48 begins at tab 49 and terminates at cut 52. Preferably, tear-strip 48 comprises two substantially parallel score lines extending through the carton board. A plastic tape 54 is preferably aligned with and attached to the tear-strip 48 to reinforce it. Perforations 64 are cut from the top of the tear-strip near the middle of side walls 32 and 34 and go diagonally up towards the junction of top wall 16 and back wall 35. When the tear-strip 48 is pulled it separates the carton until it reaches cut 52, where it pulls cleanly from the carton. Perforations 64 on container 20 help guide and continue the tear line, left by removal of the tear-strip, to the hinge point of the lid. As seen from FIGS. 1 and 3, container 20 preferably includes a pair or moon or crescent shaped cuts along the tear-strip when it turns the comer from a side wall 32 to the front wall 33 or from the front wall 33 to the side wall 34. By having the top of the tear-strip follow a curved line around the comer and not a straight line, the opening force is directed away from the comers. This helps prevent the corners from tearing during removal of the tear-strip 48.

Figure 4:
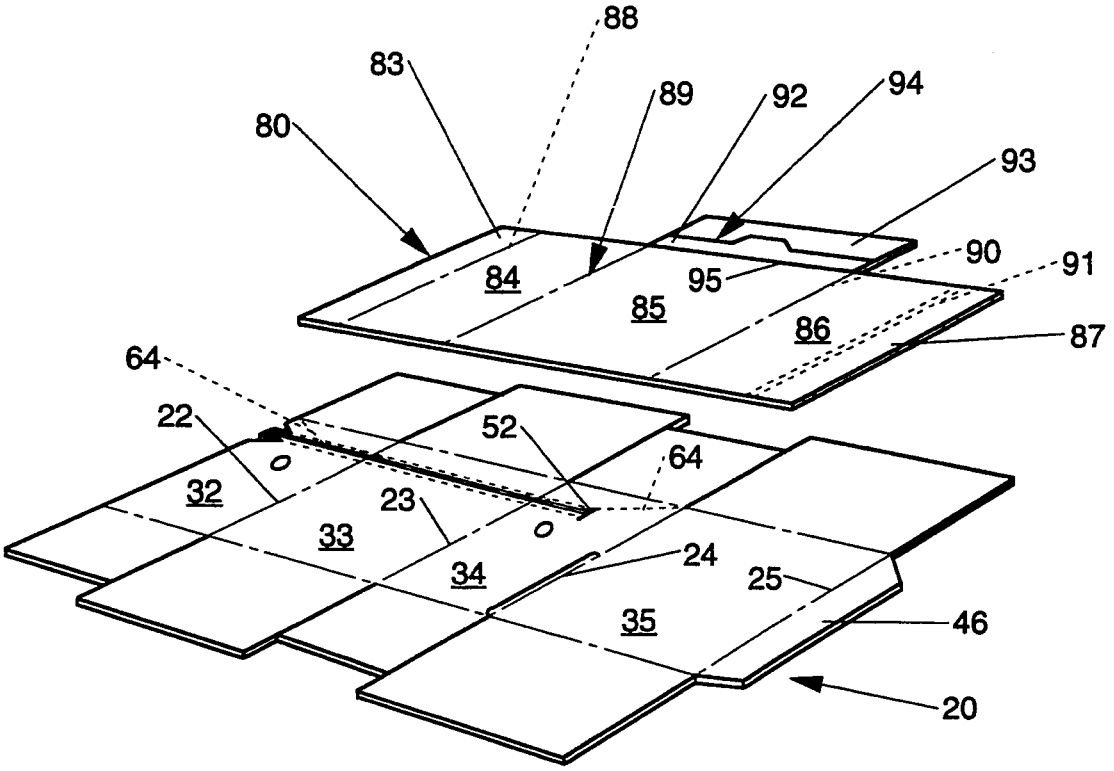
FIG. 4 is an exploded perspective view of the components which are used to make the package of FIG. 1.

Referring to FIG. 4, liner 80 is attached to the blank of container 20. Attachment is provided by applying glue to container 20 and adhering liner 80 to it. The paper board liner 80 has front panel 85, side panels 84 and 86, and back panel flaps 83 and 87, separated by four axial score lines 88, 89, 90 and 91. The score lines 88, 89, 90 and 91 in a preferred embodiment are perforated lines. Back panel flaps 83 and 87 are wide enough to be easily glued near the vertical edges of back wall 35 along side walls 32 and 34. The dimensions of the liner are slightly smaller than the corresponding dimensions of the container so that the liner fits snugly inside the container 20 when package 18 is formed.

Liner 80 further includes a locking flap 92 and securing tab 93 extending from panel 85. Locking flap 92 and securing tab 93 are separated by perforation 94. Score line 95 separates the locking flap 92 from front panel 85. The locking flap 92 and securing tab 93 are folded outwardly from the liner along score line 95, before attachment to the outer body, so that locking flap 92 and securing tab 93 are positioned between the front wall 33 and front panel 85. Glue is applied to the inner surface of front wall 33 corresponding to placement of the securing tab so that the securing tab is adhered to that portion of the front wall which becomes the interior of the front portion 3 of the lid, when the tear-strip is removed. Preferably the placement of the glue is limited so locking flap 92 is not adhered to front wall 33. Further attachment of the liner and outer body is accomplished by at least one strip of hot melt adhesive on front wall 33 of container 20 in order to adhere front panel 85 of liner 80 to front wall 33. Cold glue is positioned on back wall 35 to glue back liner flaps 83 and 87 to back wall 35. Glue is also placed on glue seam flap 46 so it can be adhered to side wall 32.

Figure 6:
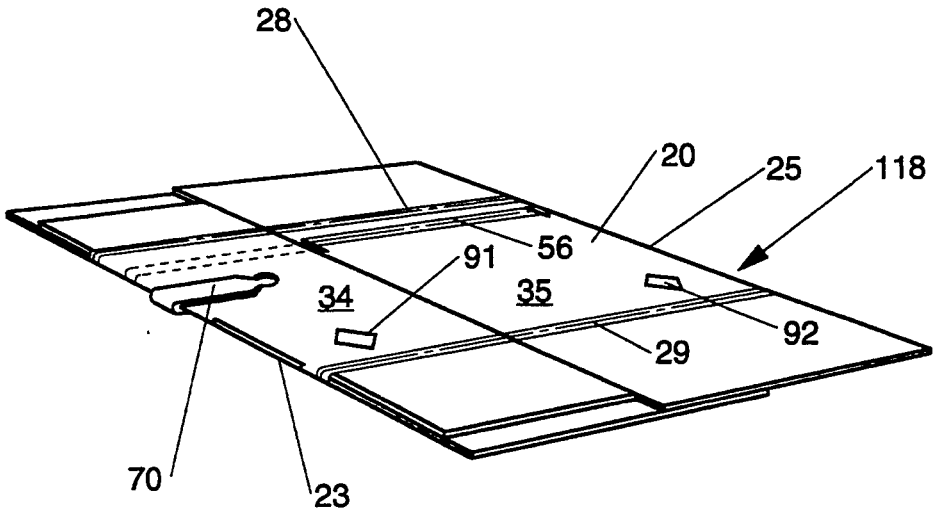
FIG. 6 is a perspective view of the package of the present invention showing it partially constructed as a sleeve.

Once liner 80 is attached to container 20 glue seam flap 46 is attached to side wall 32, as described above, a sleeve 118 is formed which can be folded along score lines 23 and 25 to collapse the sleeve to a generally flat condition as shown in FIG. 6. This is how the package is typically shipped to the manufacturer of granular material. Upon receipt by the manufacturer of granular materials, the package 18 is assembled and filled as with any other standard carton.

When the package 18 is in its flat condition, as shown in FIG. 6, multiple packages are stacked on top of one another for shipping and storage. However, because of the partial back liner and locking flap, stacks of these packages can become unstable and tip over. This is because the flat unpacked package no longer has a uniform thickness between score lines 28 and 29 due to the liner not fully extending along the back wall 35. Moreover, the sleeve will have added thickness towards the top of the package, near score line 28, due to the snap lock arrangement. Therefore, the package needs a means for stabilizing a stack of multiple stacked flat sleeves. In one embodiment this means comprises making segments of score lines 23 and 25 wider thereby giving added thickness to the sleeve in areas adjacent the thicker segments. Typically the score lines need to be at least as great as the thickness of the liner. Preferably, score line 23 is made wider along a segment near score line 29. This is because score line 23 needs only to compensate for the added thickness of the snap-lock arrangement near the top of the package and not the reduced liner because the front panel of the liner is below it. However score line 25 needs to made wider from about the mid-point of the score line, between lines 28 and 29, down to a point 1–2 inches (2.54–5.08 cm.) above line 29. This is because it needs to compensate for the thickness of the snap lock and the front panel of the liner. For ease of manufacturing both score lines can be identical, having segments of increased width, at least as great as the thickness of the liner, from their mid points, between lines 28 and 29, to a point from about 1 in. to about 2 in up from line 29.

Another means for making multiple stacked sleeves stable is to provide the container or the liner with debossers or indentations 91 and 92 as shown in FIG. 6. These indentations in the package allow the package to mate with the indentations on the package immediately above and below it. This mating action of the debossers gives the stack of sleeves stability. To give even greater stability the indentations can be combined with the thicker score lines.

Although particular embodiments of the invention have been shown and described, modification may be made to the package without departing from the spirit and scope of the present invention. The terms used in describing the invention are used in their descriptive sense and not as terms of limitation. It being intended that all equivalents thereof be included within the scope of the appended claims.

What is claimed is:

1. A snap lock top opening package for powdered or granular products, said package comprising:

a) a container comprising opposing top and bottom walls, opposing front and back walls and opposing side walls, all of which are connected together to form an interior compartment for containing said product, said container having a tear-strip extending across said front wall and at least partially across each of said side walls so that when said tear-strip is removed a lid, having front and side portions, is defined, said lid being hinged along at least one of said top wall and said back wall; and b) a liner disposed within said interior compartment of said container, said liner having a front panel and two opposing side panels connected to said front panel, said front and side panels being contiguous with said front and side walls of said container, said liner having a top edge which extends above portions of said front and side walls of said container below said tear-strip, said front panel having a locking flap extending longitudinally along said top edge of said front panel along a fold line, said locking flap extending outwardly from said package when said lid is opened, said locking flap cooperating with a securing tab, extending longitudinally along the interior of said front portion of said lid, so as to form a snap lock for said lid, said liner further including two back panel flaps, one extending from each of said side panels, each of said back panel flaps extending longitudinally along said back wall of said container at a distance less than one half of the length of said back wall, between said side walls.

2. The package according to claim 1 wherein said container and said liner are pre-assembled from a container blank and a liner blank to form a generally flat sleeve, said sleeve including a means for stabilizing a stack of multiple sleeves stacked on top of one another.

3. The package according to claim 2 wherein said means for stabilizing said stack of sleeves comprises score lines connecting each of said side panels to said back panel, said score lines having width at least as great as the thickness of said liner from their midpoints, between said top and bottom walls, to a point no less than 1 inch from said bottom wall.

4. The package according to claim 1 further including a handle for carrying said package.

5. The package according to claim 1 wherein said tear-strip comprises two substantially parallel score lines extending said front wall and at least partially across each side wall.

6. The package according to claim 5 wherein said tear-strip includes a pair of concave up crescent shape cuts where said front wall is joined to said side walls, each of said cuts extending partially across said side walls and said front wall, thereby substantially preventing tears in said package when said tear-strip is removed.

7. The package according to claim 1 wherein locking flap extends along substantially the entire length of top edge of said front panel of said liner.

8. The package according to claim 1 wherein each of said back panel flaps extend along said back wall of said container a distance greater than ½ inches.

9. The package according to claim 1 wherein said container and said liner are made from carton board.

10. A snap lock top opening package for powdered or granular products, said package comprising:

a) a container comprising opposing top and bottom walls, opposing front and back walls and opposing side walls, all of which are connected together to form an interior compartment for containing said product, said container having a tear-strip extending across said front wall and at least partially across each of said side walls so that when said tear-strip is removed a lid, having front and side portions, is defined, said lid being hinged along at least one of said top wall and said back wall;

b) a liner disposed within said interior compartment of said container, said liner having a front panel and two opposing side panels connected to said front panel, said front and side panels being contiguous with said front and side walls of said container, said liner having a top edge which extends above portions of said front and side walls of said container below said tear-strip, said front panel having a locking flap extending longitudinally along said top edge of said front panel along a fold line, said locking flap extending outwardly from said package when said lid is opened, said locking flap cooperating with a securing tab, extending longitudinally along the interior of said front portion of said lid, so as to form a snap lock for said lid, said liner further including two back panel flaps, one extending from each of said side panels, each of said back panel flaps extending longitudinally along said back wall of said container at a distance less than one half of the length of said back wall, between said side walls; and c) wherein said container and said liner are preassembled from a container blank and a liner blank to form a generally flat sleeve, said container further including a means for stabilizing a stack of multiple sleeves stacked on top of one another.

11. The package according to claim 10 wherein said means for stabilizing said stack of sleeves comprises score lines connecting each of said side panels to said back panel, said score lines having width at least as great as the thickness of said liner from their midpoints, between said top and bottom walls, to a point no less than 1 inch from said bottom wall.

12. The package according to claim 10 further including a handle for carrying said package.

13. The package according to claim 10 wherein said tear-strip comprises two substantially parallel score lines extending said front wall and at least partially across each side wall.

14. The package according to claim 13 wherein said tear-strip includes a pair of concave up crescent shape cuts where said front wall is joined to said side walls, each of said cuts extending partially across said side walls and said front wall, thereby substantially preventing tears in said package when said tear-strip is removed.

15. The package according to claim 10 wherein locking flap extends along substantially the entire length of top edge of said front panel of said liner.

16. The package according to claim 10 wherein each of said back panel flaps extend along said back wall of said container a distance greater than ⅞ inches.

17. The package according to claim 10 wherein said container and said liner are made from carton board.

* * * * *

UNITED STATES PATENT AND TRADEMARK OFFICE

CERTIFICATE OF CORRECTION

PATENT NO. : 5,373,960

DATED : December 20, 1994

INVENTOR(S) : CHARLES L. GUNN ET AL.

It is certified that error appears in the above-identified patent and that said Letters Patent is hereby corrected as shown below:

Column 1, line 31, "MULTIPLY" should read -- MULTI-PLY --.

Column 4, line 64, "comer" should read -- corner --.

Column 4, line 67, "comer" should read -- corner --.

Column 4, line 68, "comers" should read -- corners --.

Signed and Sealed this

Eighth Day of July, 1997

Bruce Lehman

*Attest:*

BRUCE LEHMAN

*Attesting Officer*

*Commissioner of Patents and Trademarks*